US008636629B2

(12) United States Patent
Zwinkels

(10) Patent No.: US 8,636,629 B2
(45) Date of Patent: Jan. 28, 2014

(54) TRAINING APPARATUS

(75) Inventor: John Zwinkels, Naaldwijk (NL)

(73) Assignee: TACX B.V., Wassenaar (NL)

( * ) Notice: Subject to any disclaimer, the term of this patent is extended or adjusted under 35 U.S.C. 154(b) by 603 days.

(21) Appl. No.: 12/939,375

(22) Filed: Nov. 4, 2010

(65) Prior Publication Data

US 2011/0136630 A1 Jun. 9, 2011

(30) Foreign Application Priority Data

Nov. 4, 2009 (NL) ..... 1037440

(51) Int. Cl.
*A63B 69/16* (2006.01)

(52) U.S. Cl.
USPC ..... 482/61

(58) Field of Classification Search
USPC ..... 482/51, 54, 57–65; 434/61
See application file for complete search history.

(56) References Cited

U.S. PATENT DOCUMENTS

| | | | | |
|---|---|---|---|---|
| 2,972,478 | A * | 2/1961 | Raines | 482/61 |
| 4,817,939 | A | 4/1989 | Augspurger et al. | |
| 2005/0008992 | A1 | 1/2005 | Westergaard et al. | |
| 2005/0209064 | A1 * | 9/2005 | Peterson et al. | 482/61 |
| 2007/0060453 | A1 | 3/2007 | Papadopoulos | |
| 2009/0264261 | A1 | 10/2009 | Papadopoulos | |

FOREIGN PATENT DOCUMENTS

WO WO2007033254 3/2007

* cited by examiner

*Primary Examiner* — Oren Ginsberg
(74) *Attorney, Agent, or Firm* — Jeffrey D. Myers; Peacock Myers, P.C.

(57) ABSTRACT

Training apparatus arranged for supporting a bicycle, comprising a ground-supported or supportable frame that is at least provided with a supporting roll or rollers for a bicycle back wheel that are movable in the frame in vertical direction, wherein the suspension of said roll or rollers is arranged to convert relative horizontal movements of the roll or rollers into vertical movements thereby compensating and/or attenuating said horizontal movements by gravity.

6 Claims, 3 Drawing Sheets

TRAINING APPARATUS

CROSS-REFERENCE TO RELATED APPLICATIONS

This application claims priority to Netherlands Patent Application Serial No. NL 1037440, entitled "Training", filed on Nov. 4, 2009, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The invention relates to a training apparatus arranged for supporting a bicycle, comprising a ground-supported or supportable frame that is at least provided with a supporting roll or rollers for a bicycle back wheel that are movable in the frame.

2. Description of Related Art

Such a training apparatus is known from U.S. Publication 2007/0060453, which concerns a bicycle exercise assembly adapted to be mounted on a supporting surface, and which is arranged to support a bicycle. This assembly includes a motion permitting frame in which the roll or rollers for the back wheel are mounted and which permit relative horizontal motion between the bicycle and the surface. With this construction it is possible that a training cyclist is encouraged to execute a natural movement during his training exercises, and to adopt a comfortable ride which better duplicates the natural feel of outdoor cycling. Although the design of this known construction allows to absorb relative horizontal movements induced by the accelerations and decelerations of the cyclist, the construction is disadvantageously complicated and bulky.

BRIEF SUMMARY OF THE INVENTION

It is an objective of the invention to provide an alternative solution for allowing that relative horizontal movements caused by accelerations and decelerations of a training cyclist are possible. It is a further objective of the invention to simplify the known construction and provide a construction which is less costly than existing designs.

BRIEF DESCRIPTION OF THE SEVERAL VIEWS OF THE DRAWINGS

The invention will hereinafter be further elucidated with reference to the drawings.

In the drawings.

Whenever in the figures the same reference numerals are applied, these numerals refer to the same parts.

DETAILED DESCRIPTION OF THE INVENTION

Figure 1:
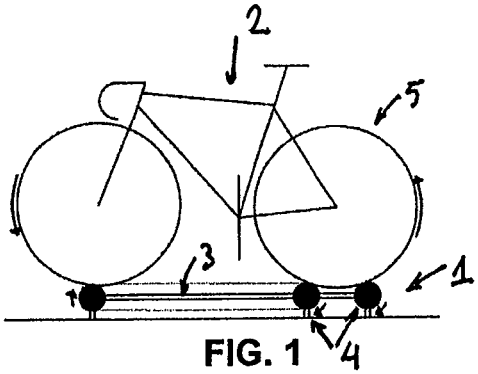
FIG. 1 shows a first type of training apparatus.

The training apparatus of the invention is embodied with the features of one or more of the appended claims.

Essentially the training apparatus of the invention has the features that at least the supporting roll or rollers for the bicycle back wheel are movably suspended in the frame in vertical direction, wherein the suspension of said roll or rollers is arranged to convert relative horizontal movements of the roll or rollers into vertical movements thereby compensating and/or attenuating said horizontal movements by gravity.

It is also possible that the training apparatus of the invention is embodied with a supporting roll or rollers for the bicycle front wheel but this is not essential. It is also possible that the bicycle front wheel has an unmovable support.

If however the bicycle front wheel is supported by a roll or rollers, it is also possible that the suspension of said roll or rollers for the bicycle front wheel is arranged to convert relative horizontal movements of the roll or rollers into vertical movements thereby assisting in compensating and/or attenuating said horizontal movements by gravity.

It is remarked that from U.S. 2005/0008992 an apparatus is known for training on a bicycle that is connected to this apparatus, wherein the bicycle is tiltable in a direction transversely to a plane defined by a frame of the bicycle. The bicycle is elevated when the bicycle frame is tilted, whereby the bicycle frame is biased towards the non-tilted position by the action of gravity. Disadvantageous of this construction is however that it does not teach or provide a solution for absorbing relative horizontal movements induced by the accelerations and decelerations of the cyclist.

In an advantageous embodiment of the training apparatus of the invention, the roll or rollers for the bicycle back wheel are at their extremities directly or indirectly supported by at least one pendulum arm that has a fixed pivoting point on the frame. This provides an easy and effective solution for absorbing and attenuating horizontal movements by converting these horizontal movements to vertical movements.

If the training apparatus of the invention has two rollers for the bicycle back wheel, it is preferable that at their extremities the rollers for the bicycle back wheel are directly or indirectly suspended by double pendulum arms arranged in the form of a parallelogram construction, wherein the said pendulum arms are provided with a connecting link to secure their concerted swinging back and forth.

In an alternative embodiment the roll or rollers for the bicycle back wheel may also be supported by a subframe, which subframe is provided within the frame and connects to said frame by means of a pendulum arm or arms.

In still another embodiment of the training apparatus according to the invention, the roll or rollers for the bicycle back wheel are suspended in a curved slit or slits that are arranged in the frame. This provides a predefined conversion from horizontal movement to vertical movement of the roll or rollers which suits to utilize the forces of gravity for reducing horizontal movements induced by the accelerations and decelerations of the training cyclist. Beneficiary then the curved slit or slits possess a lowest point approximately in the middle of said slit or slits.

With reference first to FIG. 1, a training apparatus denoted with reference 1 is shown that is arranged for supporting a bicycle 2. This training apparatus 1 comprising a ground-supported or -supportable frame 3 that is at least provided with a supporting roll or rollers 4 for a bicycle back wheel 5.

Figure 2:
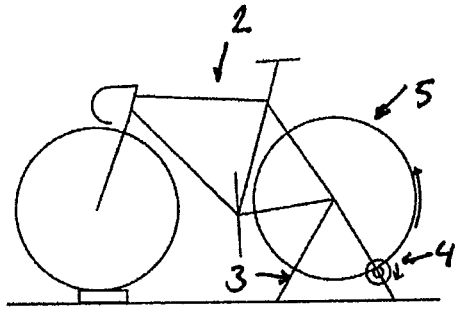
FIG. 2 shows a second type of training apparatus.

FIG. 2 shows another training apparatus in which a frame 3 is applied that provides a single roll for support of the back wheel 5 of the bicycle 2.

The invention is applicable to both the training apparatus shown in FIG. 1 and the training apparatus shown in FIG. 2.

Figure 3:
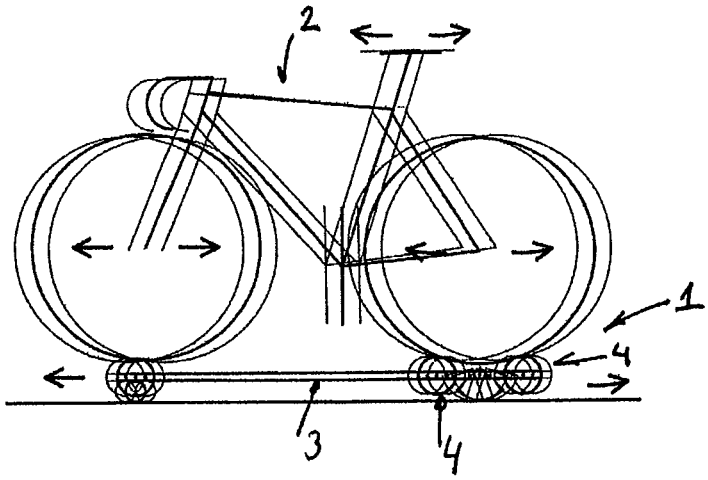
FIG. 3 shows schematically a first embodiment the training apparatus of the invention supporting a bicycle.

In FIG. 3 the training apparatus 1 of the invention is further shown, wherein at least the supporting roll or rollers 4 for a bicycle back wheel 5 are movable in the frame 3 so as to allow for their movement in vertical direction. The construction is arranged such that the suspension of said roll or rollers enables relative horizontal movements of said roll or rollers 4 induced by acceleration or deceleration of the bicycle 2 (as indicated with the arrows) to covert into vertical movements, thereby compensating and/or attenuating said horizontal movements by gravity.

In the FIGS. 4-7 schematically different embodiments of only the suspension of the rollers 4 of the apparatus 1 of the invention for supporting a bicycle back wheel 5 are shown, which will be elucidated further hereinafter.

Figure 6:
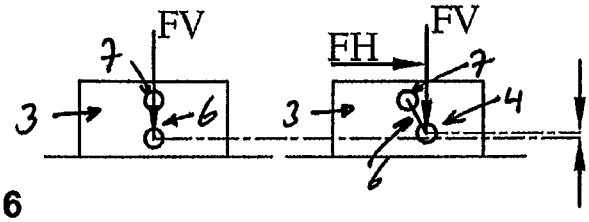

FIG. 6 shows schematically the embodiment of the suspension of a roll or rollers 4 of the apparatus 1 of the invention in which at their extremities the roll or rollers for the bicycle back wheel 5 are directly or indirectly supported by at least one pendulum arm 6 that has a fixed pivoting point 7 on the frame 3. The figure at the left of FIG. 6 shows the pendulum arm 6 in a resting position, whereas the figure on the right shows the pendulum arm 6 after it has moved to the right due to a force FH, causing that the roll 4 has moved vertically upwards. At this position the roll 4 undergoes the force of gravity FV which counteracts the force FH due to which the roll 4 has moved to the right.

Figure 5:
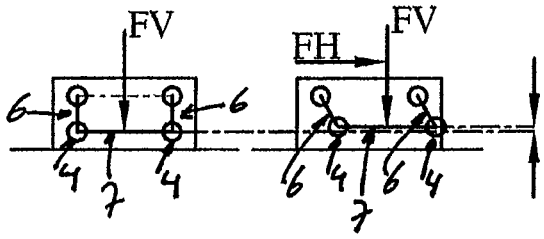

FIG. 5 shows the embodiment in which there are two rollers 4 for the bicycle back wheel, and that at their extremities the rollers 4 are directly or indirectly suspended by double pendulum arms 6 arranged in the form of a parallelogram construction, wherein the said pendulum arms 6 are provided with a connecting link 7 to secure said arms 6 perform a concerted swinging back and forth. Again the figure at the left of FIG. 5 shows the pendulum arms 6 in a resting position, whereas the figure on the right shows the pendulum arms 6 after they have due to the connecting link 7 concertedly moved to the right due to a force FH, causing that the rollers 4 have moved vertically upwards. At this position the rollers 4 undergo the force of gravity FV which counteracts the force FH due to which the rollers 4 have moved to the right.

Figure 7:
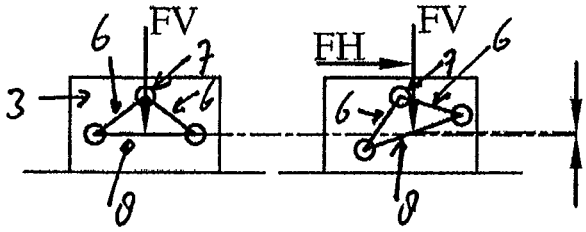

It is also possible that the roll or rollers 4 for the bicycle back wheel are supported by a subframe 8, which is schematically shown in FIG. 7. This subframe 8 is provided within the frame 3 and connects to said frame 3 by means of a pendulum arm or arms 6. The operation is similar or the same as explained hereinabove with reference to the forces FH and FV in FIGS. 5 and 6.

Figure 4:
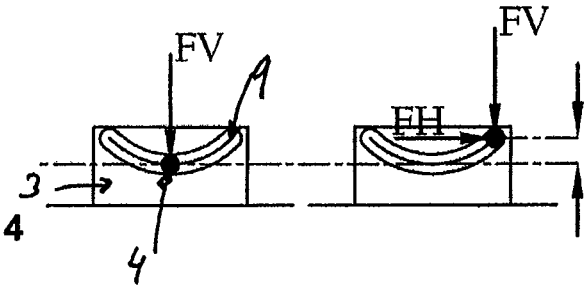
FIGS. 4-7 show schematically different embodiments of the suspension of the rollers of the apparatus of the invention for supporting a bicycle back wheel.

Yet another embodiment is shown in FIG. 4 in which the roll 4 or rollers for the bicycle back wheel are suspended in a curved slit 9 or slits that are arranged in the frame 3. The curved slit 9 or slits possess a lowest point approximately in the middle of said slit or slits to arrange that at all times the roll 4 undergoes a force due to the gravity FV which counteracts any horizontal force FH that acts on this roll 4. The roll 4 or rollers thus possess a preferential position which equates with this lowest point in the middle of the slit 9.

Figure 8:
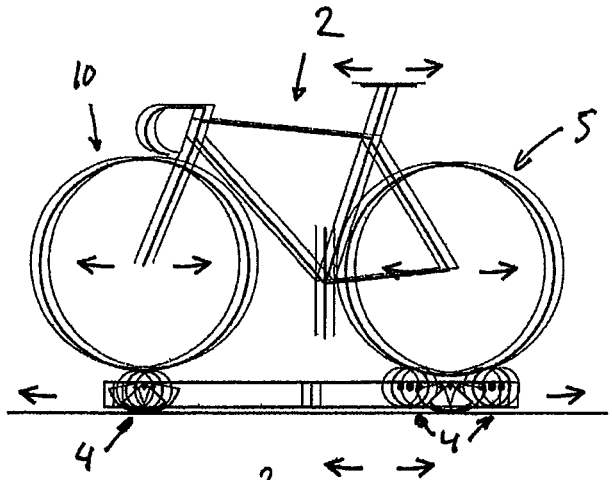
FIG. 8 shows schematically a second embodiment of the training apparatus of the invention supporting a bicycle.

For the purpose of illustrating the versatility of the training apparatus of the invention, FIG. 8 shows schematically a second embodiment of this training apparatus 1 supporting a bicycle 2, in which also the frontwheel 10 of the bicycle 2 is supported by a roll 4 that allows for back-and-forth movement in the horizontal direction which is counteracted by a vertical movement induced by said horizontal movement. The suspension of the roll 4 that supports the frontwheel 10 is accordingly implemented in the manner as explained with reference to FIGS. 4-7.

Figure 9:
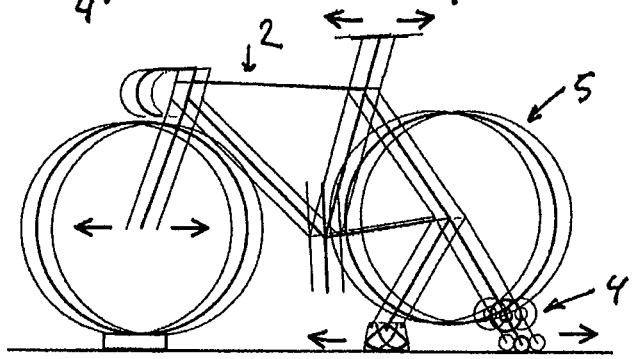
FIG. 9 shows schematically a third embodiment of the training apparatus of the invention supporting a bicycle.

Finally reference is made to FIG. 9, which shows schematically a third embodiment of the training apparatus 1 of the invention supporting a bicycle 2. This training apparatus 1 employs a single roll 4 to support the back wheel 5. This single roll 4 usually is provided with an electromagnetic friction brake, such as based on induced eddy currents in the magnetic material of the brake. This single roll 4 can likewise be suspended in the manner explained with reference to FIGS. 4-7.

What is claimed is:

1. Training apparatus arranged for supporting a bicycle, comprising a ground-supported or -supportable frame that is at least provided with a supporting roll or rollers for a bicycle back wheel that are movable in the frame, wherein at least the supporting roll or rollers for the bicycle back wheel are movably suspended in the frame in vertical direction, and wherein the suspension of said roll or rollers is arranged to convert relative horizontal forward and backward movements of the roll or rollers in a plane defined by the frame and induced by acceleration or deceleration of the bicycle into vertical movements in said plane defined by the frame thereby compensating and/or attenuating said horizontal movements by gravity.

2. Training apparatus according to claim 1, wherein at their extremities the roll or rollers for the bicycle back wheel are directly or indirectly supported by at least one pendulum arm that has a fixed pivoting point on the frame.

3. Training apparatus according to claim 1, wherein there are two rollers for the bicycle back wheel, wherein at their extremities the rollers for the bicycle back wheel are directly or indirectly suspended by double pendulum arms arranged in the form of a parallelogram construction, wherein the pendulum arms are provided with a connecting link to secure their concerted swinging back and forth.

4. Training apparatus according to claim 1, wherein the roll or rollers for the bicycle back wheel are supported by a subframe, the subframe is provided within the frame and connects to the frame by means of a pendulum arm or arms.

5. Training apparatus according to claim 1, wherein the roll or rollers for the bicycle back wheel are suspended in a curved slit or slits that are arranged in the frame.

6. Training apparatus according to claim 5, wherein the curved slit or slits possess a lowest point approximately in the middle of said slit or slits.

* * * * *